US005704288A

United States Patent [19]

John

[11] Patent Number: 5,704,288

[45] Date of Patent: Jan. 6, 1998

[54] PRINTING UNIT WITH PRINTING CYLINDERS DIRECTLY-DRIVEN BY INDUCTION MOTORS

[75] Inventor: Thomas John, Augsburg, Germany

[73] Assignee: MAN Roland Druckmaschinen AG, Offenbach am Main, Germany

[21] Appl. No.: 665,525

[22] Filed: Jun. 17, 1996

[30] Foreign Application Priority Data

Jun. 16, 1995 [DE] Germany ..... 195 21 827.2

[51] Int. Cl.[6] ..... B41F 13/00

[52] U.S. Cl. ..... 101/216; 101/212; 101/184; 101/247

[58] Field of Search ..... 101/212, 216, 101/174, 141, 247, 191, 181, 182, 183, 184, 185

[56] References Cited

U.S. PATENT DOCUMENTS

| | | | |
|---|---|---|---|
| 3,732,815 | 5/1973 | Greiner et al. | 101/216 |
| 4,324,180 | 4/1982 | Jiruse et al. | 101/216 |
| 4,509,425 | 4/1985 | Hahn et al. | 101/216 |

FOREIGN PATENT DOCUMENTS

| | | |
|---|---|---|
| 2924616 C2 | 6/1979 | Germany . |
| 37 15 536 | 10/1991 | Germany . |
| G 93 06 369 U1 | 4/1993 | Germany . |
| 42 11 379 | 10/1993 | Germany . |
| 1203749 | 9/1970 | United Kingdom . |

OTHER PUBLICATIONS

"Frei schwebend und doch fest gehalten", Technische Rundschau (Technical Review) pp. 38–42, vol. 13 (1994).

*Primary Examiner*—Christopher A. Bennett

*Attorney, Agent, or Firm*—Cohen, Pontani, Lieberman & Pavane

[57] ABSTRACT

A printing machine including multiple interactively arranged printing cylinders, at least some of which are directly-driven by induction motors. The induction motors have rotors that are connected to the cylinder mantle of the printing cylinder, and stators directly or indirectly connected to the side walls of a printing unit along substantially rigid axes, so that the respective rotors and stators associated with each printing unit are radially displaced from each other relative to the axes to define a gap between adjacent printing cylinders. The relative radial position of the printing cylinders is determined not by any mechanical mounting but, rather, by way of magnetic lateral forces of the induction motors. Each directly-driven printing cylinder is also provided with asymmetrical prestress means which holds the printing cylinder in the off (non-printing) position, eccentric relative to the on (printing) position, regardless of the electrical control and in such a way that a gap remains between the interacting printing cylinders.

11 Claims, 3 Drawing Sheets

PRINTING UNIT WITH PRINTING CYLINDERS DIRECTLY-DRIVEN BY INDUCTION MOTORS

BACKGROUND OF THE INVENTION

1. Field of the Invention

The present invention relates to a printing machine with multiple interactively arranged printing cylinders, and more particularly to such an arrangement for a rotary printing machine in which some of the printing cylinders are directly driven by induction motors and designed to facilitate ready removal of the printing sleeves.

2. Description of the Related Art

Printing machines are generally comprised of multiple printing units connected to one another by synchronous shafts. A typical printing unit includes both inking units and wetting units. Each printing unit comprises an arrangement of printing cylinders including rubber blanket cylinders, plate cylinders and distributor cylinders driven via toothed gears which are powered by a main drive. It is highly desirable to individually control the positioning movement of the printing units as well as the inking and wetting units within an individual printing unit in both a printing ("ON") and a non-printing ("OFF") position. Couplings have commonly been used to control the individual printing units and inking units or wetting units within a printing machine.

German patent publication DE 93 06 369 U1 discloses a driving structure for a printing cylinder unit in which the rubber blanket cylinder and the plate cylinder are each connected and directly driven by an electric motor. In an alternative driving structure embodiment described in that German patent, the cylinder mantle and rotor of a standard electric motor are integrated into a single unit. When the rotor of the electric motor is integrated into the cylinder an air gap exists between the rotor and stator which cylinders using known devices, such as double-eccentric bearings. However, with such driving structures, blocking blocks must be used to provide torque support for the double-eccentric bearings after positioning of the printing cylinder. Thus, on/off positioning of the individual printing cylinders is not possible while the printing machine is running.

Other conventional methods and arrangements heretofore used for on/off positioning movement of individual printing cylinders include adjusting of the print widths, adjusting of mechanical stops, or adjusting of stops using a motor controllable via a control device, as described in German publication DE 42 11 379.

Previously, it has been known to control the printing cylinders using a bearing-free induction motor in which the rotor is integrated into a printing cylinder and the stator is connected to the rigid axis of the printing cylinder, as for example disclosed in an article in 13 *"Technische Rundschau"* (Technical Review) 38–42 (1994). As therein described, by including a control winding it is possible to produce, in addition to the torque, magnetic lateral forces suitable for the contact-free bearing of the rotor. The article also describes methods for controlling the lateral forces and the rotor position. Bearing-free induction motors make it possible to compensate for bending in printing cylinders and to set and control the print widths of two adjacent cylinders.

In addition to the ability to independently control the positional movement of individual printing cylinders, it would also be advantageous for the printing unit to include a support system designed so that the printer sleeves may be easily changed. The design of such a support system would require that one of the two cylinder bearings be supported in such a way that it would be possible to remove the support of a particular printing cylinder and pass the printing sleeve through an opening in one of the side walls of the printing unit. Heretofore, only printing units having complex and expensive mechanical support systems designed for accommodating changes of the printing sleeve, such as that disclosed in German patent publication DE 37 15 536, have been available.

Therefore, it would be highly desirable to provide a printing cylinder drive structure which eliminates the need for expensive mechanical drive systems comprising synchronous positioning, such as double-eccentric bearings, pivotable rests, rods, adjustment cylinders or adjustable stops. It would also be desirable to provide a simple support system for a printing unit in which the printing sleeve may be easily changed.

SUMMARY OF THE INVENTION

The present invention is directed to a printing machine comprising multiple interactively arranged printing cylinders, at least some of which are directly-driven by induction motors. The induction motors have rotors which are connected to the cylinder mantle of the printing cylinder, and stators directly or indirectly connected to the side walls of a printing unit along substantially rigid axes, in such a way that the respective rotors and stators associated with each printing unit are radially displaced from each other relative to the axes so that a gap exists between the printing cylinders. The relative radial position of the printing cylinders is determined not by any mechanical mounting but, rather, by means of magnetic lateral forces of the induction motors. Each directly-driven printing cylinder is also provided with an asymmetrical prestress device which generates asymmetrical prestress forces counter to magnetic lateral forces produced by the induction motors. The asymmetrical prestress forces hold the printing cylinder in an off position, eccentric relative to an on position, regardless of the electrical control in such a way that a gap remains between the directly-driven printing cylinder and an adjacent interacting printing cylinder.

An object of the invention is accordingly to provide an interactive printing cylinder arrangement with multiple directly-driven printing cylinders that render heretofore employed on/off positioning movement means superfluous and nonetheless make it possible to position an individual printing cylinder as described, in its off position, independently of an adjacent printing cylinder.

Another object of the invention is to provide printing cylinders directly-driven by induction motors, the rotors of which are directly or indirectly connected in a substantially rigid manner to the side wall of a printing unit so that the respective rotors and stators are displaced from one another with a gap remaining between them, and such that because the relative radial positioning of the printing cylinders is determined not by any mechanical bearing but, rather, by means of magnetic lateral forces of the induction motor, functional unification of the individual or direct drive and the on/off positioning of printing cylinders is achieved.

A further object of the invention is to provide directly-driven printing cylinders with asymmetrical prestress means that hold the printing cylinders in their off position, eccentric relative to the on position, regardless of the electrical control, in such a way that a gap remains between the interacting printing cylinders.

Another object of the invention is to provide a support system that makes it possible to easily change or replace the printing sleeves.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWINGS

In the drawings, wherein like reference numerals delineate similar elements throughout the several views.

DETAILED DESCRIPTION OF THE PRESENTLY PREFERRED EMBODIMENTS

According to the invention, all of the printing cylinders and rollers heretofore driven via geartrains in a printing unit are replaced with printing cylinders directly-driven via induction motors. Off positioning of a printing cylinder is achieved by applying asymmetrical prestress forces which holds the printing cylinder in the off position, eccentric relative to an on position in such a way that a gap remains between the interacting printing cylinders. On the other hand, on positioning of the printing cylinder is achieved by applying magnetic lateral forces generated by the induction motor counter to the asymmetrical prestress forces.

Figure 1:
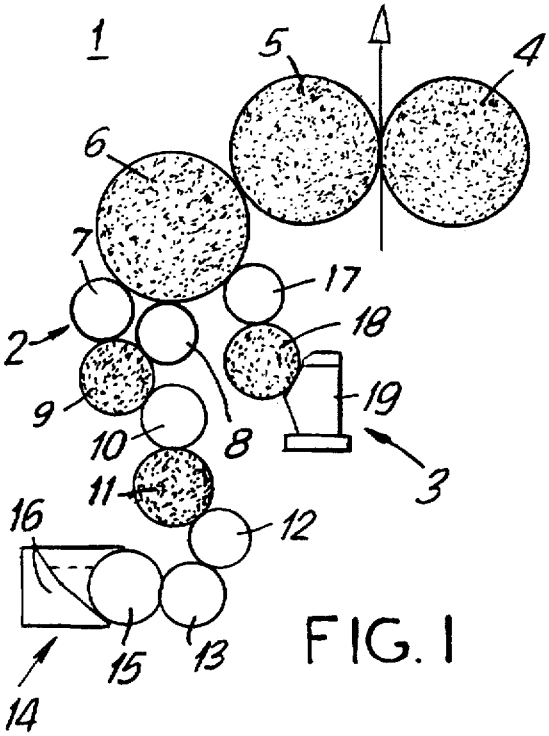
FIG. 1 diagrammatically depicts a printing cylinder arrangement of an offset printing unit constructed in accordance with the invention and including a conventional inking unit.

FIG. 1 depicts a multiple printing cylinder arrangement in an offset printing unit. 1 and including an inking unit 2 and a two-cylinder wetting unit 3. The printing unit i includes a rubber blanket cylinder 5 interacting with a plate cylinder 6. A counter-pressure cylinder 4 interacts with and counters the pressure exerted from the rubber blanket cylinder 5. Inking unit 2 comprises ink application cylinders 7 and 8, ink distributor cylinders 9 and 11, intermediary cylinders 10 and 12, film cylinder 13, inking device 14, ductor 15 and ink blade 16. Ink application cylinders 7 and 8 are both disposed in contact with plate cylinder 6 and a first ink distributor cylinder 9. A second ink distributor cylinder 11 is disposed in contact with the first ink distributor cylinder 9 via a first intermediary cylinder 10. In turn, ink distributor cylinder 11 is located in contact with film cylinder 13 via a second intermediary cylinder 12. A ductor 15 is operatively connected to the film cylinder 13 and an underlying ink blade 16 of an inking device 14. Wetting unit 3 is disposed in contact with the plate cylinder 6 and comprises a wetting application cylinder 17 that contacts a centrifugal wetting unit 19 via a wetting distributor cylinder 18. In the printing cylinder arrangement shown in FIG. 1, for example, counter-pressure cylinder 4, rubber blanket cylinder 5, plate cylinder 6 and three distributor cylinders 9, 11 and 18 are (as denoted by the shading) each directly-driven, as by an induction motor.

Figure 2:
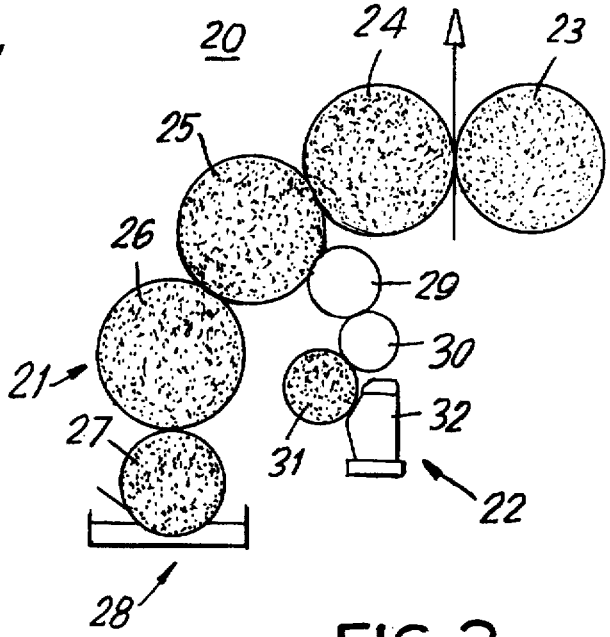
FIG. 2 diagrammatically depicts a printing cylinder arrangement of an offset printing unit in accordance with the invention and including an anilox short inking unit.

FIG. 2 shows a multiple printing cylinder arrangement in an offset printing unit 20 and including anilox short inking unit 21 which, in contrast to the printing cylinder arrangement of FIG. 1, includes a three-cylinder wetting unit 22. The printing unit 20 comprises a rubber blanket cylinder 24 and a plate cylinder 25. As in the arrangement of FIG. 1, the printing cylinder arrangement of FIG. 2 includes a counter-pressure cylinder 23, as previously described, disposed in contact with the rubber blanket cylinder 24. The anilox short inking unit 21 comprises an ink application cylinder 26, a raster cylinder 27 and an inking device 28, each located in respective contact with the other. The wetting unit 22 interacts with a plate cylinder 25 and comprises a wetting application cylinder 29, a wetting transfer cylinder 30, a wetting distributor cylinder 31 and a centrifugal wetting unit 32, each disposed in respective contact with the other. In the printing cylinder arrangement shown in FIG. 2, for example, counter-pressure cylinder 23, rubber blanket cylinder 24, plate cylinder 25, ink application cylinder 26, raster cylinder 27 and wetting distributor cylinder 31 are (as denoted by the shading) each directly driven, as by an induction motor.

Referring now to FIGS. 3 and 4, here again all directly-driven cylinders are denoted by their being shaded. Arrows 33 indicate the directions in which asymmetrical prestress forces produced by an asymmetrical prestress device must act in order to move the directly-driven printing cylinders in the printing cylinder arrangements shown in FIGS. 1 and 2, respectively, from the on to the off position. All non-driven (unshaded) cylinders are maintained in a substantially fixed position.

Figure 5:
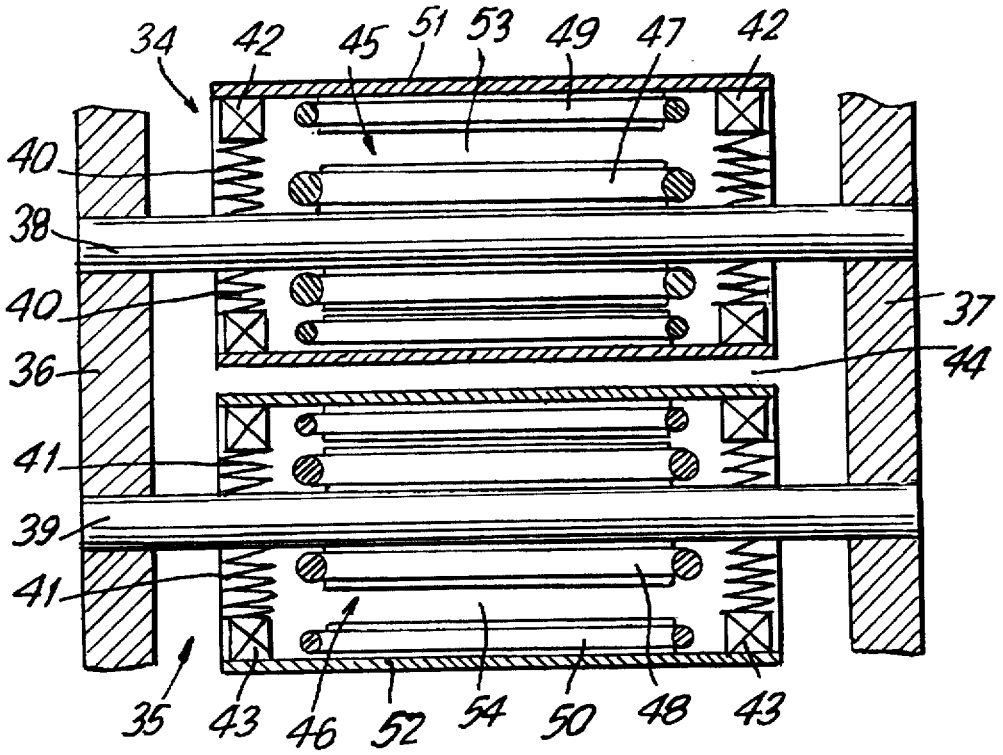
FIG. 5 diagrammatically depicts two adjacent directly-driven printing cylinders with integrated induction motors in the off position.

FIG. 5 representatively depicts two adjacent directly-driven printing cylinders 34 and 35 in the off position. The printing cylinders 34, 35 are mounted along substantially rigid axes 38 and 39, respectively, between opposed side walls 36 and 37, and are directly-driven by induction motors 45 and 46, respectively. Each induction motor 45, 46 has a corresponding stator 47, 48 that is connected to the axis 38, 39, respectively. In addition, each induction motor 45, 46 includes a corresponding rotor 49, 50 which is in turn connected to a printing cylinder mantle 51, 52, respectively, of the printing cylinder. Also connected to the printing cylinder mantles 51, 52 are bearings 42, 43. Asymmetrical prestress devices, such as the springs 40 and 41, are connected between the bearings 42, 43 and the substantially rigid axes 38, 39. The springs radially displace the printing cylinder mantles relative to their respective axes and atop the bearings, thereby forming a gap 44 between the two adjacent printing cylinders. Distances 53 and 54 between the stators 47, 48 and their associated rotors 49, 50 are, sized or selected to permit and accommodate the radial deviations resulting from the prestress forces exerted by the springs.

Figure 6:
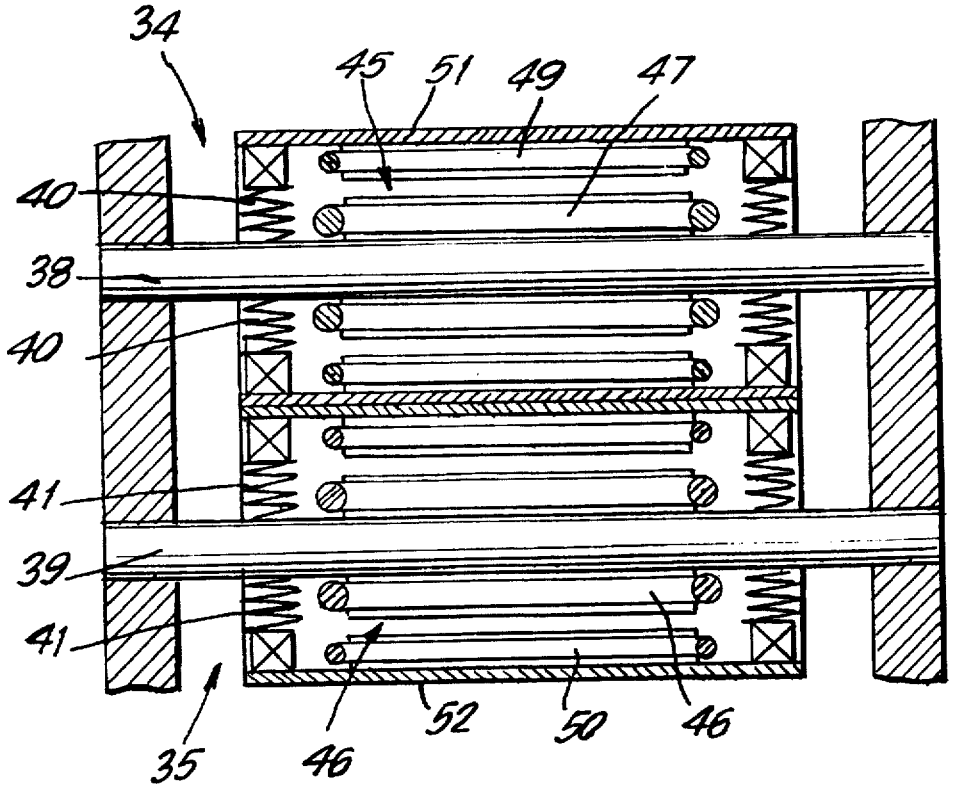
FIG. 6 diagrammatically depicts two adjacent directly-driven printing cylinders with integrated induction motors in the on position.

FIG. 6 shows two adjacent directly-driven printing cylinders 34 and 35 in the on position. The printing cylinders 34, 35 are directly-driven to the on position by integrated induction motors 45 and 46, respectively, which generate magnetic lateral forces counter to the prestress forces produced by the springs, thereby eliminating the gap between the two printing cylinders so that the cylinder mantles 51, 52 are moved into contact.

Figure 7:
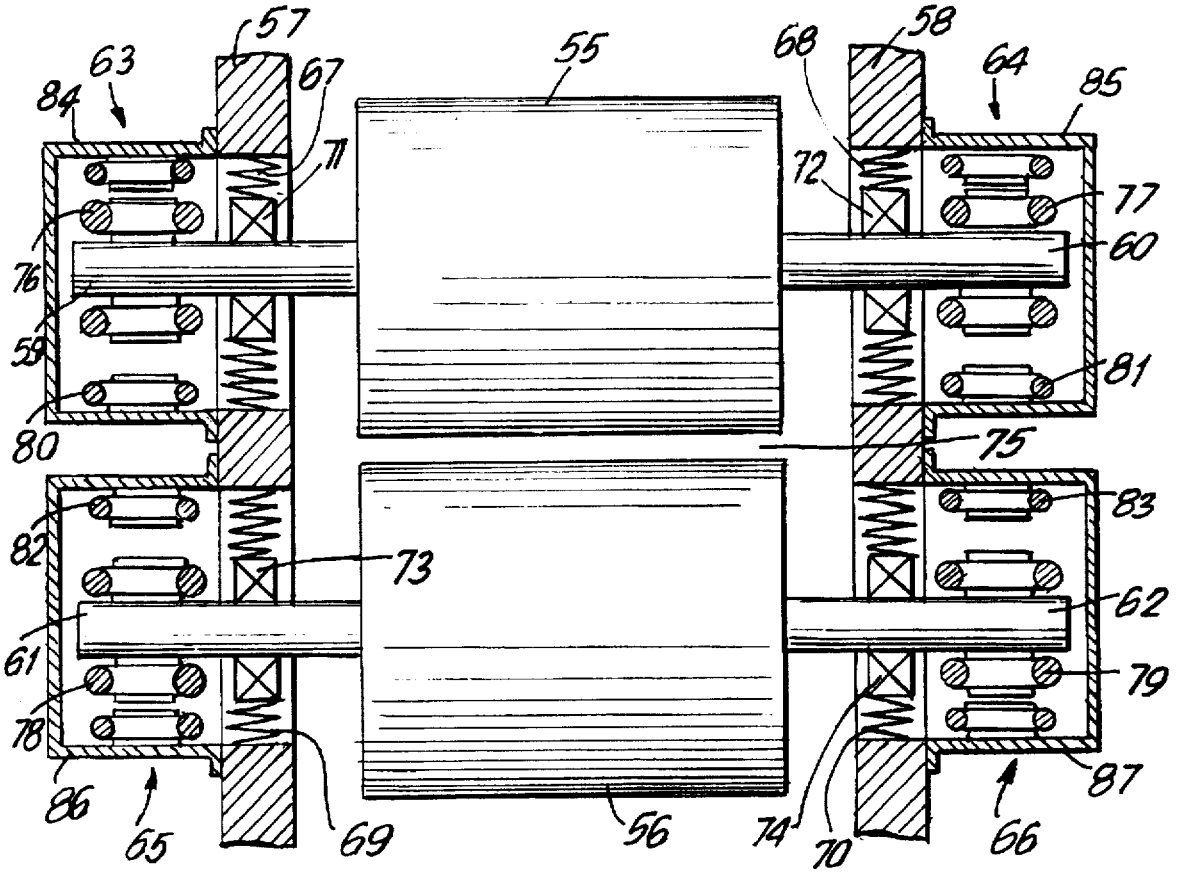
FIG. 7 diagrammatically depicts two adjacent directly-driven printing cylinders with external induction motors in an off position.

In an alternative design, FIG. 7 shows two printing cylinders 55, 56 in the off position with each cylinder directly-driven by two external induction motors 63, 64 and 65, 66, respectively. A shaft journal 59 connects one side of printing cylinder 55, an induction motor 63 and a side wall 57 interposed between the induction motor 63 and printing cylinder 55; a second shaft journal 60 connects the other side of printing cylinder 55, an induction motor 64 and a side wall 58 interposed between the induction motor 64 and the printing cylinder 55. In a similar manner, shaft journal 61 connects one side of printing cylinder 56, an induction motor 65 and the side wall 57 interposed between the induction motor 65 and printing cylinder 56; a second shaft journal 62 connects the other side of printing cylinder 56, an induction motor 66 and the side wall 58 interposed between the induction motor 66 and the printing cylinder 56. Induction motors 63 and 65 are flanged onto side wall 57 and induction motors 64 and 66 are flanged onto side wall 58. Each printing cylinder 55 and 56 is directly-driven in synchronization by its two induction motors 63, 64 and 65, 66, respectively. The rotors 76, 77, 78 and 79 are fixedly connected to the respective shaft journals 59, 60, 61 and 62, while the stators 80, 81, 82 and 83 are connected to a respective motor housing 84, 85, 86 and 87 enclosing each inductor motor. Asymmetrical prestress forces may be generated using springs 67, 68, 69 and 70. Bearings 71, 72 are mounted in the side walls 57, 58 interposed between the springs 67, 68 and the shaft journals 59, 60. In a similar fashion, bearings 73, 74 are mounted in the side walls 57, 58 interposed between the springs 69, 70 and the shaft journals 61, 62. The springs radially displace the printing cylinders relative to their on position atop the bearings, thereby forming a gap 75 between the two printing cylinders 55 and 56. The distances between the rotors 76, 77 and 78, 79 and the stators 80, 81 and 82, 83 are selected or sized so as to permit or accommodate the radial deviation resulting from the prestress forces exerted by the springs.

The particular arrangement of printing cylinders may, as a matter of design choice, comprise both directly-driven and non-driven cylinders. Thus, a directly-driven printing cylinder as shown in FIGS. 5, 6 and 7 may also operate in conjunction with a non-driven cylinder mounted in a substantially rigid manner. It is also within the contemplation of the invention to implement the on/off positioning as hereinabove described using all directly-driven cylinders; however, it is not absolutely necessary to do so. For example, in a printing unit with an anilox short inking unit 21, as shown in FIGS. 2 and 4, it may be advantageous to mount the raster cylinder 27 in a substantially rigid manner without asymmetrical prestress devices or to electrically block lateral offset of the induction motor.

Figure 3:
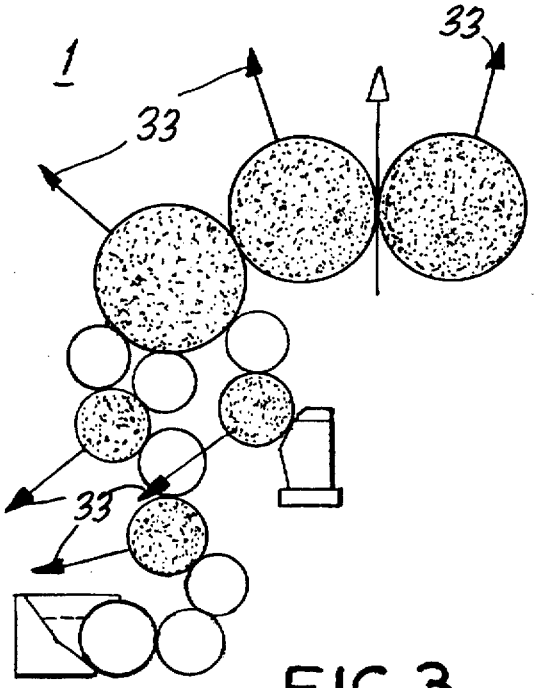
FIG. 3 diagrammatically depicts the direction in which asymmetrical prestress forces must act to move each directly-driven printing cylinder of the printing cylinder arrangement shown in FIG. 1 to an off position.
Figure 4:
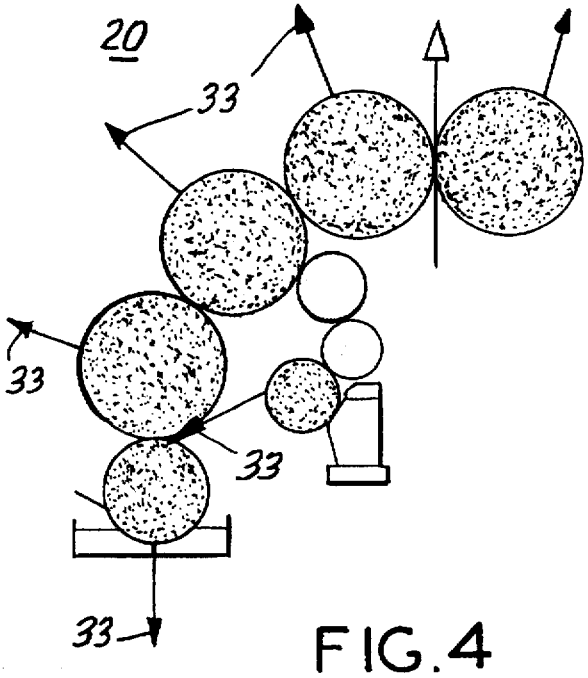
FIG. 4 diagrammatically depicts the direction in which asymmetrical prestress forces must act to move each directly-driven printing cylinder of the printing cylinder arrangement shown in FIG. 2 to an off position.

By producing a pressure force via the induction motor in a direction opposite that indicated by arrow 33 in FIGS. 3 and 4, print width adjustments and resettings may be readily implemented as needed, even during printing operations, in accordance with a characteristic curve.

Uniting the functions of direct drive and on/off positioning as herein taught makes it possible—for the purpose of optimizing the roll-off conditions between two directly-driven printing cylinders or between a directly-driven printing cylinder and a cylinder fixed in a substantially rigid manner (i.e. non-driven)—to adjust the speed and the pressure force relative to one another so that no movement or a defined relative movement is achieved at the contact point.

When several induction motors are used adjacent one another within a printing cylinder, it is possible to compensate for bending forces and to apply different pressure forces across the width of the cylinder.

In order to achieve an oscillating movement of the distributor, analogous to that found in prior printing units, in a printing cylinder arrangement according to the invention, the printing cylinders or the printing cylinder mantles or the axes of the particular printing cylinders may be moved via standard drives to achieve such oscillating movements. This can be done, for example, via pneumatically-driven or hydraulically-driven printing cylinders acting directly thereon.

Figure 8:
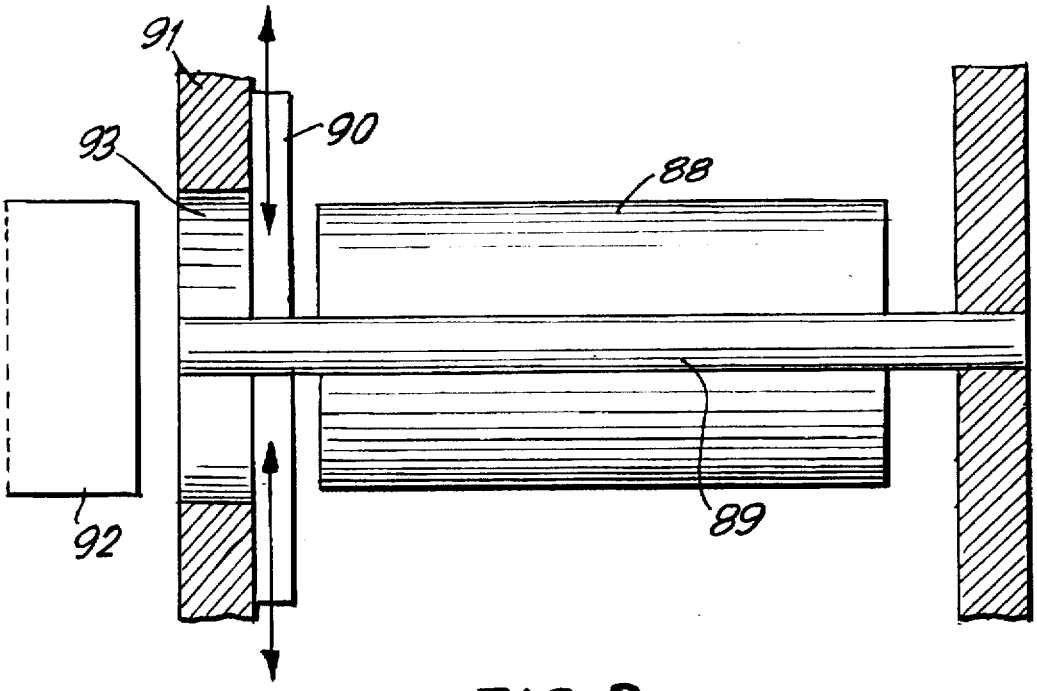
FIG. 8 diagrammatically depicts a printing sleeve support system for a directly-driven printing cylinder with an integrated induction motor.

FIG. 8 depicts a design of a directly-driven printing cylinder 88 in accordance with the invention and which permits the printing sleeve 92 to be easily changed or replaced. The directly-driven printing cylinder 88, in accordance with the invention as shown in FIGS. 5 and 6, eliminates the need for mechanical rollers or glide bearings and mechanical on/off positioning mechanisms, thereby permitting the axis 89 to be clamped by means of a clamping device 90 which is movable relative to a side wall 91. The printing sleeve 92 may be readily removed and replaced by displacing the clamping device 90 away from the axis 89 to permit the printing sleeve to be passed through an opening 93 defined in side wall 91.

The very simple bearing and/or securability of the axes of the printing cylinder enables use of this straight forward printing sleeve technology, especially in a printing unit with an anilox short inking unit, on not only the rubber blanket and plate cylinders but, in addition, on the ink application and raster cylinders.

It should also be mentioned that the printing cylinder arrangement according to the invention can be used not only for offset printing units, but for all types of printing units such as those for letterpress printing, gravure printing and flexographic printing. Furthermore, hydraulic, pneumatic and similar devices capable of asymmetrically prestresssing the printing cylinders or printing cylinder mantles may be substituted for the springs 40, 41, 67, 68, 69 and 70 shown by way of example in FIGS. 5, 6 and 7.

Thus, while there have been shown and described and pointed out fundamental novel features of the invention as applied to several preferred embodiments thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

I claim:

1. A rotary printing machine with multiple interactively arranged printing cylinders, comprising:

a frame having two side walls;

a directly-driven printing cylinder mounted between the two side walls, the directly-driven printing cylinder having a rotatable part rotatable about an axis;

an interacting printing cylinder adjacent said directly-driven printing cylinder; and at least one electrically controlled induction motor operable for producing magnetic forces lateral to the rotational axis to directly drive said directly-driven printing cylinder, said induction motor having a rotor connected to the rotating part of the directly-driven printing cylinder and a stator predeterminately spaced from the rotor and fixed to at least one of the side walls for adjusting a radial position of said directly-driven printing cylinder relative to the adjacent interacting printing cylinder through operation of the induction motor using the magnetic lateral forces generated between the rotor and stator, when the induction motor is operated, the rotor and stator being coaxial, said induction motor including means for producing asymmetrical prestress forces, said asymmetrical prestress force producing means normally urging said directly-driven printing cylinder to an off position in which the directly-driven cylinder is radially spaced from the adjacent cylinder, regardless of electric control of the induction motor, eccentrically relative to an on position in which the directly-driven printing cylinder is disposed in contact with the adjacent interacting printing cylinder by the lateral magnetic forces.

2. The rotary printing machine of claim 1, wherein two induction motors are provided to drive said directly-driven printing cylinder.

3. The rotary printing machine of claim 1, wherein said directly-driven printing cylinder includes a printing cylinder mantle and a substantially rigid axle between the two side walls, the mantle being mounted on the axle, and wherein the rotor is connected to the printing cylinder mantle and the stator is connected to the axle.

4. The rotary printing machine of claim 2, further comprising:

a shaft journal fixedly connected to the rotor of said induction motor and said directly-driven printing cylinder; and a motor housing fixedly connected to the stator and one of the side walls.

5. The rotary printing machine of claim 1, wherein said asymmetrical prestress force producing means comprises a spring.

6. The rotary printing machine of claim 1, wherein the printing machine is an offset printing machine.

7. The rotary printing machine of claim 1, wherein the printing machine is an offset printing machine with an anilox short inking unit.

8. The rotary printing machine of claim 1, wherein the adjacent interacting printing cylinder comprises a second directly-driven printing cylinder.

9. The rotary printing machine of claim 1, wherein the adjacent interacting printing cylinder comprises a non-driven printing cylinder.

10. The rotary printing machine of claim 1, further comprising means for clamping an opening in one of said side walls, wherein said clamping means in a first position abuts the axle and in a second position is sufficiently displaced relative to the axle to accommodate passage of a printing sleeve.

11. A direct drive for a printing cylinder mounted between sidewalls of a rotary printing machine having an interacting printing cylinder adjacent the printing cylinder, the direct drive comprising at least one electrically controlled induction motor operable for producing magnetic forces lateral to a rotational axis of the printing cylinder, said induction motor having a rotor connectable to a rotating part of the printing cylinder, and a stator predeterminately spaced from the rotor and fixed to at least one sidewall of the printing machine, for adjusting a radial position of said directly-driven printing cylinder relative to the adjacent interacting printing cylinder through operation of the induction motor using the magnetic lateral forces generated between the rotor and stator when the induction motor is operated, the motor and stator being coaxial, said induction motor including means for producing asymmetrical prestress forces, said asymmetrical prestress force producing means normally urging said directly driven printing cylinder to an OFF position in which the directly driven cylinder is radially spaced from the adjacent cylinder, regardless of electric control of the induction motor, eccentrically relative to an ON position in which the directly driven printing cylinder is disposed in contact with the adjacent interacting printing cylinder by the lateral magnetic forces.

* * * * *